United States Patent [19]

Hoefelmayr

[11] Patent Number: 4,877,062

[45] Date of Patent: Oct. 31, 1989

[54] TEMPLE

[76] Inventor: Tilman Hoefelmayr, Steinwichslenstr. 20, CH-9052 Niederteufen, Switzerland

[21] Appl. No.: 101,363

[22] Filed: Sep. 25, 1987

[30] Foreign Application Priority Data

Sep. 26, 1986 [DE] Fed. Rep. of Germany ..... 3632821

[51] Int. Cl.[4] ..... D03J 1/22

[52] U.S. Cl. ..... 139/294; 26/73

[58] Field of Search ..... 139/292, 294–298; 26/73; 66/147

[56] References Cited

U.S. PATENT DOCUMENTS

| | | | |
|---|---|---|---|
| 497,692 | 5/1893 | Stimpson | 139/298 |
| 3,324,525 | 6/1967 | Knapp et al. | 139/294 |

FOREIGN PATENT DOCUMENTS

| | | | |
|---|---|---|---|
| 9594 | 5/1880 | Fed. Rep. of Germany . | |
| 16864 | 2/1882 | Fed. Rep. of Germany . | |
| 20310 | 11/1882 | Fed. Rep. of Germany . | |
| 30372 | 1/1885 | Fed. Rep. of Germany . | |
| 87851 | 1/1895 | Fed. Rep. of Germany . | |
| 84472 | 12/1895 | Fed. Rep. of Germany . | |
| 1259588 | 1/1968 | Fed. Rep. of Germany | 26/73 |
| 2253364 | 5/1974 | Fed. Rep. of Germany . | |
| 2407074 | 8/1974 | Fed. Rep. of Germany . | |
| 2458000 | 3/1977 | Fed. Rep. of Germany . | |
| 1037803 | 9/1953 | France | 139/294 |
| 984 | of 1874 | United Kingdom | 139/294 |
| 1061206 | 3/1967 | United Kingdom | 26/73 |

*Primary Examiner*—Henry S. Jaudon

*Attorney, Agent, or Firm*—Robbins & Laramie

[57] ABSTRACT

The present invention refers to a temple for holding or for laterally tensioning a woven fabric, in particular on weaving looms, comprising endless guide means having displaceably arranged therein members provided with needles for engagement with said woven fabric, said guide means extending and being arranged in such a way that the needles of at least two members are simultaneously in engagement with the edge of the woven fabric and that, in the course of the needling-in operation, the needles brought into engagement with the woven fabric, are located at a greater distance from the longitudinal axis of the width of woven fabric than in the course of the de-needling operation. The failures occurring in the case of such a temple are now eliminated by providing an appropriate amount of play between the individual members and by guaranteeing at the same time that the members are returned to the point of needling-in in an appropriate manner.

24 Claims, 8 Drawing Sheets

TEMPLE

BACKGROUND AND SUMMARY OF THE INVENTION

The present invention refers to a temple for holding or for laterally tensioning a woven fabric, in particular on weaving looms, comprising endless guide means having displaceably arranged therein members provided with needles for engagement with said woven fabric, said guide means extending and being arranged in such a way that the needles of at least two members are simultaneously in engagement with the edge of the woven fabric and that, in the course of the needling-in operation, the needles brought into engagement with the woven fabric are located at a greater distance from the longitudinal axis of the width of woven fabric than in the course of the de-needling operation. The temples can be used on textile machines of all types through which widths of woven fabric pass, such as stenter, steaming, shrinking, drying, setting and dressing machines.

Temples generally have to fulfil the task of preventing the woven fabric from shrinking in transverse direction. In the case of weaving looms, temples are provided immediately after the weaving reed, especially for avoiding that damage is caused to the weaving reed and to the warp due to a change in the direction of the warp.

The general problem in the case of temples is to be seen in the fact that such temples have to take up a high transverse tension, but that any marks which may be caused by said temples on the woven fabric are to be avoided and that, in particular, the occurrence of torn pin holes is to be avoided.

A great variety of temples has already become known. In the case of a first type, the expander extends over the entire breadth of the width of fabric and it extends parallel to the weft threads. In this case, the woven fabric is normally guided such that it is partially wound round thread or porcupine cylinders. The main disadvantage of such temples are to be seen in a non-uniform transverse tension as well as in the fact that they are expensive and complicated and, in most cases, difficult to handle.

Another type of temples are the socalled cylinder temples, which are known, for example, from German-pat. 84 472 or from German-Offenlegungsschrift 22 53 364. These cylinder temples are attached to the selvages on the right- and on the left-hand side, the axes of said cylinders extending respectively parallel to the weft threads. Radially or obliquely extending spiked wheels, which are brought into engagement with the woven fabric, are arranged on said cylinders. These cylinder temples show the disadvantage that they produce only minor transverse tension, that the pin holes tear more frequently and that damage may also be caused to the edges of the fabric. German patents 20 310 and 30 372 also disclose socalled star-wheel temples in the case of which the star wheel is rotatably arranged in a plane parallel to the plane of the woven fabric and in the case of which the selvage is bent by 90° and attached to the needles of the star wheel. The disadvantage of these star wheels is to be seen in the fact that the whole transverse tension is practically taken up by only a small number of needles so that the result practically is a point load. This may easily result in tearing of the pin holes.

In order to reduce the point load, German patents 9594 as well as 87 851 also disclose socalled chain temples in the case of which the chain revolved in a plane at right angles to the plane of the woven fabric or in a plane parallel to the weaving plane. With the aid of these chains, it can be achieved that the force of the transverse contraction of the woven fabric, which is to be taken up by the temple, can be distributed over a longer piece of the woven fabric. However, these chain temples on both sides of the width of woven fabric must be slightly inclined in the longitudinal direction of the width of woven fabric so as to reduce the transverse tension of the woven fabric at the outlet of the temple relative to the inlet of the temple adjacent the weaving reed to such an extent that de-needling of the woven fabric can be effected without causing any damage to said woven fabric. If the chain temples are adjusted such that they extend parallel to the selvages, there will be a great risk of tearing of the fabric at the outlet of the temple in the course of the de-needling operation.

However, due to the fact that the chain temples are inclined relative to the longitudinal axis of the width of woven fabric, the chain is also subjected to tension in the longitudinal direction. This causes stretching of the chain, and this will result in a large number of cases in which the chain is in need of repair as well as in a high amount of maintenance work, since the chain has to be retensioned extremely often with the aid of a chain adjuster.

Moreover, a chain temple shows additional disadvantages, which are to be seen in the fact that complicated screw connections have to be used for the individual combinations of members, in cases in which the chain has to be dismountable. Such a chain requires lubrication for smooth operation. This, however, is extremely difficult.

In order to avoid the disadvantages of a chain temple, while still utilizing its advantages, the applicant tried in tests to replace the respective chain by individual, independent members, which each carry needles and which are adapted to be displaced in a common endless guide means, a system which was, for example, already known from German patent specification 16 864. Although the members slided in the endless guide means excellently and easily, the temple, when used on a weaving loom, showed a tendency to blocking after a short period of time, whereas the members slided again without any problems after removal of the temple. Hence, additional tests were carried out in the case of which an enlarged amount of overall play between the members in the endless guide means was employed. However, in all cases mutual jamming of the members located on the return portion of the endless guide means occurred again after a short period of operation.

Hence, the present invention is based on the task of providing a temple of the type mentioned at the beginning, which permits smooth operation.

In accordance with the invention, this task is solved by the features that the members are supported such that they can be displaced relative to one another, that the overall amount of play between all members on the endless guide means is greater than or equal to the elongation of the woven fabric between the point of needling-in and the point of de-needling, and that there are provided means for holding the respective next member, which follows the member just carrying out the needling-in operation, in abutting contact with the member which is just carrying out the needling-in operation or which has just finished said operation, or within a maximum distance with regard to the member which is just carrying out the needling-in operation or which has just finished said operation.

Such an arrangement guarantees smooth operation without any jamming of the individual members, since it has been found out that, due to the inclination of the temples of known weaving mechanisms and the resultant narrowing of the width of woven fabric, the width of woven fabric will be subjected to lengthening or to an elongation in its longitudinal direction, and this lengthening or elongation will then cause jamming. The overall amount of play is assumed to be the sum of the distances between the members which are regarded as being non-compressible. If the distance between two neighbouring members is filled fully or partly with a material which is fully compressible in response to a compression pressure acting on the members, the distance between the members has to be regarded as the amount of play. In addition, an arrangement, in the case of which the demanded overall amount of play between the members is created only in response to a pressure on the members in their direction of movement due to an elastic deformation of the guide means, must be regarded as an equivalent embodiment as well.

In accordance with a preferred embodiment of the invention, there are provided at least two springs between respective pairs of juxtaposed members, said springs holding the respective members at such a distance from one another that the overall amount of play is distributed in a substantially uniform manner over the distances between the respective members, and that these two springs are provided between members which are substantially diametrically opposed on the guide path. Such an arrangement can be obtained in a comparatively easy way with the aid of pressure springs, although, in this connection, the disadvantage has to be accepted that, during the needling-in operation of the members, the distance remaining between the members having provided between them a spring will be greater than the distance remaining between the other members.

In accordance with another preferred embodiment of the invention, several or all members have attached thereto resilient buffer means, which hold the neighbouring members at a small distance from one another and which, in response to a certain amount of pressure acting on the members in the direction of sliding, are adapted to be compressed until the members mutually abut on one another. It is thus possible to distribute the overall amount of play provided between the members over the distances between all neighbouring members in a uniform manner when operation is being started so that the distance between two neighbourng members is comparatively small. An arrangement which proved to be particularly advantageous in this connection is an arrangement in the case of which each member has provided therein a recess which extends in the longitudinal direction of the member and which has inserted therein a piece of material having an e.g. rod-shaped configuration and consisting of a rubber material or a plastic material, said piece of material being of such a length that, when this buffer means abuts on the next following member and when no effect is produced by a compression force acting on the members, the members are located at a distance from one another which corresponds at least to the part of the overall amount of play obtained in the case of a uniform distribution of said overall amount of play among all neighbouring members. A buffer material which turned out to be particularly useful is polyurethane.

In accordance with an additional preferred embodiment of the invention, several or all neighbouring members are bevelled inwards towards the guide means on their sides facing one another,and a tappet member is arranged between respective pairs of neighbouring abutting members, said tappet member being, in response to a movement of the members, entrained and guided in the endless guide means, and in an area of the endless guide means in which the members are out of engagement with the width of woven fabric a cam path is provided, which springily projects in the path of movement of the tappet members and which, while said tappet members pass over said cam path, holds said tappet members in a position in which they are displaced relative to the neighbouring members and in which said tappet members hold the respective neighbouring members at a distance from one another. Said tappet members consist preferably of balls, cylinders or wedges. Such an arrangement has an extremely long service life and is practically maintenance-free.

It will be expedient when the cam path is formed by a ramp which is pretensioned by a spring and which, in response to a pressure acting in the direction of mutual abutting contact and applied to the members which are out of engagement with the width of woven fabric, can be displaced via the tappet members and against the force exerted by the spring to a position outside of the original path of movement of the tappel members. The amount of play between the members or between some members which are out of engagement with the width of woven fabric can thus arbitrarily be increased or reduced depending on the compression pressure acting on the members.

In accordance with an additional embodiment of the invention, a star wheel is provided having an axle which is supported such that it can be displaced in the direction of the endless guide means and which is springily pretensioned relative to said endless guide means, at least one star engaging between two neighbouring members, which are out of engagement with the width of woven fabric, for keeping said members at a distance from each other as long as excessive pressure is not applied to the members. Also such an arrangement can easily be realized and it has a long service life and is practically maintenance-free.

Another possible structural design of the present invention is that there is provided a slide member, which is adapted to be moved forwards and backwards along the members out of engagement with the width of woven fabric in step with the needling-in movement of a member and which engages behind a new member in the case of each backward motion, said slide member, when moving forward, applying a pressure to all the members which are positioned in front of it in the direction of movement so as to hold the next member, which follows the member just carrying out the needling-in operation, in abutting contact with said member just carrying out the needling-in operation. Actuation of the slide member can be effected by providing a rotatably supported star wheel which successively engages with a respective star thereof between two members which are in engagement with the width of woven fabric, and by providing a pivotably supported two-armed lever having one arm articulated on the slide member, which is springily pretensioned in its direction of movement, and having its other arm arranged such that it projects into the path of movement of the ends of the stars of the star wheel.

An arrangement which is practically independent of the different elongations occurring in the case of the different types of woven fabrics is an arrangement in the case of which there is provided a device for introducing a jet of compressed air in the direction of the forward movement of the members which are out of engagement with the width of woven fabric, said jet of compressed air being used for returning the respective members which have finished the de-needling operation into abutting contact with the member just carrying out the needling-in operation.

BRIEF DESCRIPTION OF THE DRAWINGS

In the following, the present invention will be explained in detail on the basis of preferred embodiments shown in the drawings, in which.

DETAILED DESCRIPTION OF THE PREFERRED EMBODIMENTS

Figure 1:
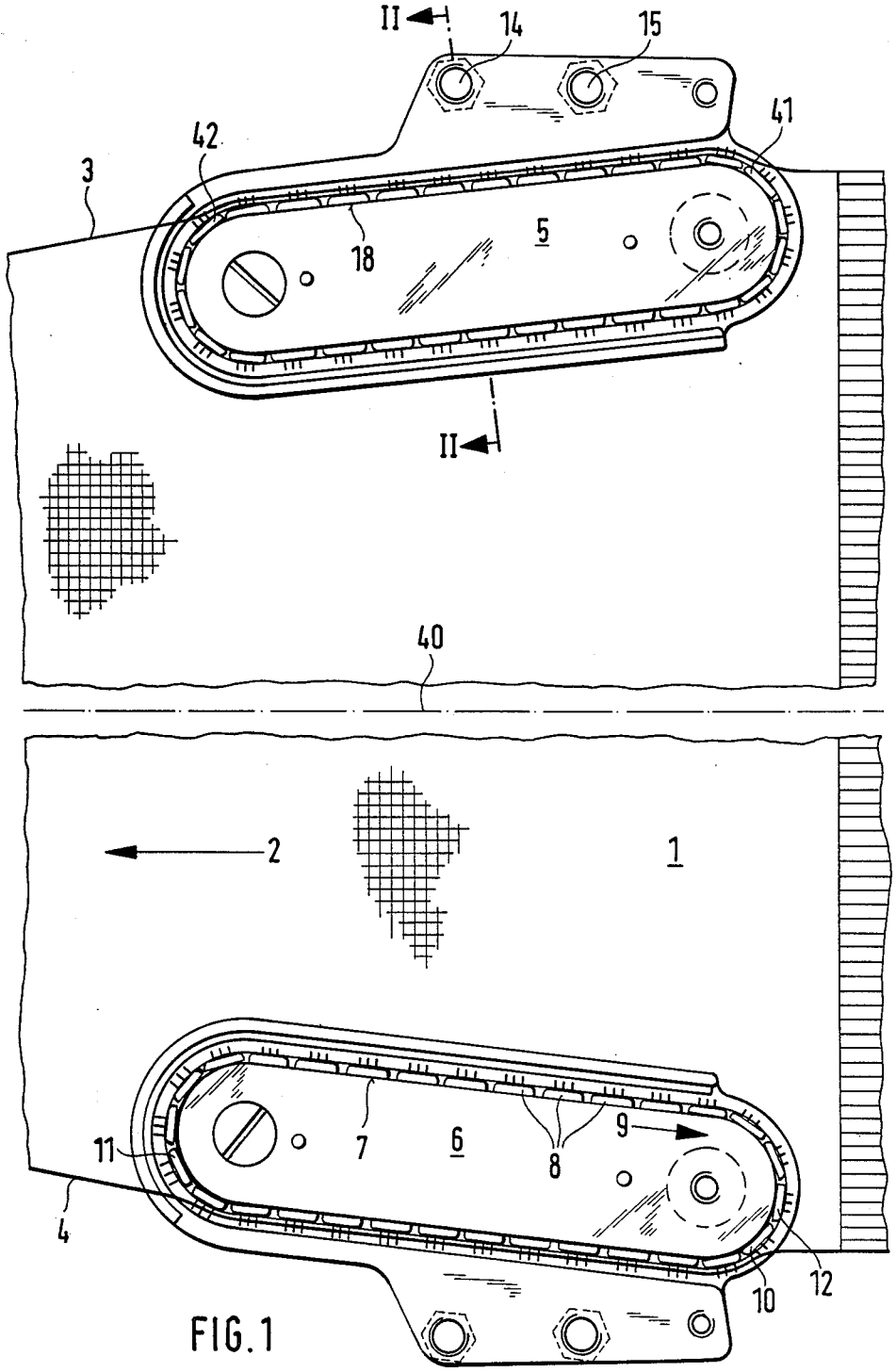
FIG. 1 shows, in a schematic top view, a schematic representation of two temples according to the present invention, which act on the oppositely disposed selvages.

FIG. 1 shows a width of woven fabric 1 directly after the weaving reed, which is not shown, said width of woven fabric 1 moving in the direction of the arrow 2. The oppositely disposed selvages 3, 4 are each acted upon by a temple 5, 6. The temples are identical but provided with mirror-inverted structural designs. Each temple is provided with an endless guide means 7, which has the form of an elongate oval and which will be explained in detail on the basis of FIG. 2 hereinbelow, as well as with several members 8 adapted to be displaced along said guide means. When the width of woven fabric is being advanced in direction 2, the members 8 migrate along the guide means 7 in the direction of arrow 9. Each member carries several needles, which are respectively located in the plane extending through the guide means 7 and which project outwardly away from said guide means. In FIG. 1, the member 10 of the temple 6 is just being brought into engagement with the selvage 4, whereas the member 11 has already been fully disengaged from said selvage. In the following, the operation where the needles of a member are brought into engagement with the woven fabric will be referred to as needling-in and the operation where the needles are brought out of engagement with the woven fabric will be referred to as de-needling. In order to facilitate needling-in, an insertion guide plate is often used, which is adjustably secured to the front of the temple, but which is not shown in the present case.

The members positioned between members 10 and 11 are fully in engagement with the selvage 4. The members 11 and the members preceding said members 11 in the direction of movement up to the member 12 preceding the member 10 are completely out of engagement with the width of woven fabric and, consequently, they can be displaced freely.

Figure 2:
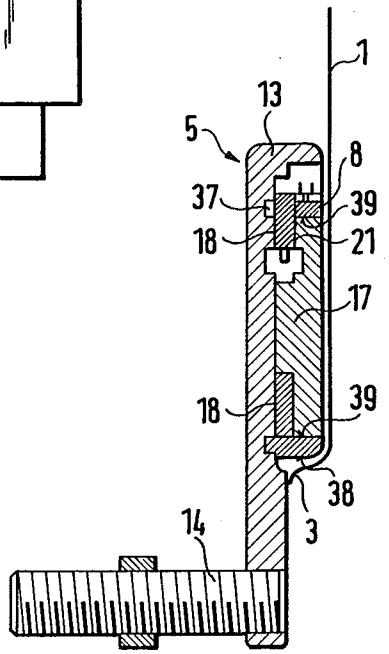
FIG. 2 shows a longitudinal cut through a temple along the line II—II in FIG. 1, FIG. 3 to FIG. 5 respectively show a side view, front view and top view of an individual member.

As can be seen from FIG. 2, the temple 5 is mainly defined by a guide rail in the form of a flat plate 13 having secured thereto fastening pins 14 and 15 with the aid of which it is possible to hold the temple 5 in a stationary manner on an appropriate device, which is not shown, along said width of woven fabric 1. An additional guide rail or plate 17 cooperates with said guide rail plate 13 so as to define the endless guide means 18 for the members 8, which can be seen from FIG. 1.

Figure 4:
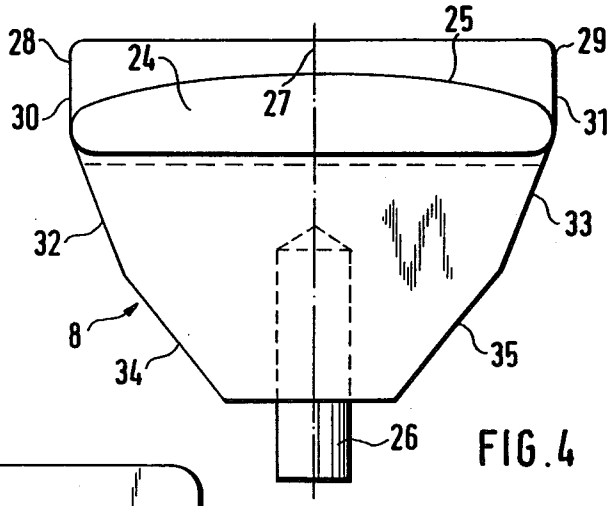
Figure 5:
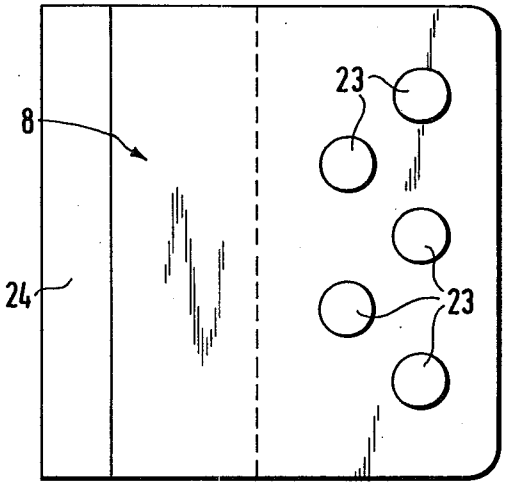
Figure 3:
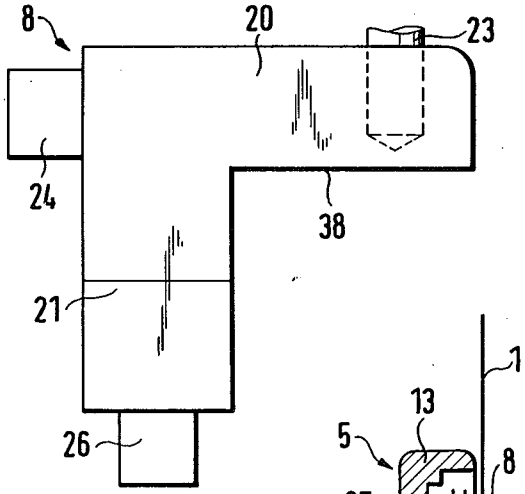

As can be seen from FIG. 3 to 5, the individual members 8 have, when seen in a longitudinal section, a substantially L-shaped structural design and are provided with a first leg 20 and with a second leg 21. The members are preferably formed of one part.

On the side facing away from the second leg 21, the first leg 20 carries several needles 23 extending substantially at right angles to the first leg 20. The first leg 20 has formed thereon a projection 24, which, as is best shown by FIG. 4, essentially has the shape of a rectangle, said rectangle being, however, convex on its upper side 25 and rounded at its ends. On the side facing away from the first leg 20, the second leg 21 is provided with a projection 26, which can be formed, for example, by a pin inserted in this second leg 21. The structural design of the member 8 is practically mirror-inverted with regard to the plane extending at right angles to the plane of drawing and extending through the longitudinal axis 27. The lateral edges 28 and 29 (FIG. 4) of the member 8 first extend in an upper portion 30 and 31, respectively, parallel to the longitudinal axis 27. In a following central portion 32 and 33, respectively, said lateral edges extend downwards towards the longitudinal axis 27 thus forming bevelled edges, said bevel being inclined even more strongly in the lower lateral portions 34 and 35.

As can be seen from FIG. 2, the members 8 are guided between the guide rail plates 13 and 17 with the front and with the back of the second leg 21, the projection 24 being positioned in a groove 37 formed in the guide rail plate 13, whereas the underside 38 of the first leg 20 rests on a lateral edge 39 of the guide rail plate 17 and is supported thereby. Whereas the lateral edge 39 takes up essentially the whole tensile force which acts on a member, the essential function of the projection 24 of the member 8 engaging the groove 37 is that each member is held in the endless guide means. FIG. 2 shows that the guide rail plate 13 determining the plane of the endless guide means extends below and essentially parallel to the plane of the width of woven fabric 1, and that the width of woven fabric is bent by 90° at the selvage 30 and is in engagement with the needles of specific members 8.

The jamming of the members, which has been observed during tests carried out with the temples described in the above-mentioned figures, is, apparently, caused by the following processes: as can be seen from FIG. 1, the two temples 5 and 6 are each arranged at an oblique angle relative to the longitudinal axis 40 of the width of woven fabric 1. This arrangement has been selected for achieving that, for example, the member 41, which is just carrying out the needling-in operation, is located at a distance from the longitudinal axis 40 which is greater than the distance between said longitudinal axis 40 and the member 42, which is just carrying out the de-needling operation. This means that the transverse tension acting on the member 41 exceeds the transverse tension acting on the member 42, since at the point where said member 42 is located the breadth of the width of woven fabric as a whole has already narrowed. Due to the lower amount of transverse tension acting on the member 42, better de-needling is made possible. However, one of the effects entailed by this type of arrangement is that, since the width of woven fabric as a whole becomes smaller between the members 41 and 42, it is simultaneously subjected to elongation in the direction of the longitudinal axis 40. If an arrangement were provided in the case of which the members 8 were lined up in a row on the endless guide means 7 practically without any amount of play, the effect produced by the width of woven fabric on the members in needled-in engagement therewith would be the same as the effect on a chain temple, i.e. due to the stretch in the woven fabric, said stretch tries to enlarge the distance between the individual members, and this, in the end, will cause damage to the fabric, since the distance between the individual members cannot be enlarged. It follows that the advantage desired in comparison with a chain temple can be achieved by means of an arrangement of members only if, between said members, an overall amount of play exists which is at least equal to the elongation occurring in the width of woven fabric between the point of needling-in and the point of de-needling.

Due to the elongation of the width of woven fabric, a distance forms between the members which are in needled-in engagement with said fabric, the magnitude of said distance depending on the magnitude of the elongation of the respective woven fabric. If the overall amount of play of the members provided on the endless guide means is smaller than the elongation of the fabric between the point of needling-in and the point of de-needling, it will easily be understandable that the last member, which is just carrying out the de-needling operation, has applied thereto a substantial tension of the width of woven fabric in its longitudinal direction, and the other members which are not in engagement with the width of woven fabric cannot yield to this tension, since the last member, which is just carrying out the de-neelding operation, applies via the remaining members substantial pressure to the member which is just carrying out the needling-in operation, said member being, however, held in position due to fact that it is preceded by a member which is in engagement with the width of woven fabric. This pressure applied to the members results in jamming of said members. Hence, the maximum amount of overall play of the members should be equal to or larger than the maximum elongation occurring on the relevant length of the fabric which is just being processed, or, even better, equal to or larger than the maximum elongation of all fabrics to be processed.

However, if the overall amount of play is enlarged to an arbitrary extent or, for example, at least by omitting a further member in addition to the overall amount of play which has already been provided, this will not at all exclude jamming, but the following effect will be produced: if an initial condition is taken as a basis, in the case of which precisely the necessary number of members is in needled-in engagement with the fabric, said members having an adequate distance from one another with regard to the assumed elongation of the fabric, and if the widths of woven fabric are now caused to run on, the first member carrying out the de-needling operation will push forward the other members freely provided on the rest of the guide means. In view of the fact that the overall amount of play has additionally been enlarged by the omission of a further member, the displacement of the first free member to the position in which it would actually have been capable of being brought into needled-in engagement with the width of woven fabric will, at the earliest, take place when de-needling of the first member from said width of woven fabric occurs. For this period of time, a member is missing, which should have carried out the needling-in operation in the meantime. Hence, the width of woven fabric is not supported along the length of one member. When the width of woven fabric is being moved on, jamming will be inevitable, unless the starting conditions in the form of the length of the members, the length of the width of fabric between the first needling-in operation and the de-needling operation as well as the elongation of the fabric which is just being processed have been chosen such that the last member has just fully finished its de-needling operation before the new member moved up to the width of woven fabric can actually carry out the needling-in operation. This will, however, not be the case in most situations. In this case, however, jamming will be inevitable, since the member carrying out the needling-in operation will carry out said operation at a lower speed than the member carrying out the de-needling operation, said member having imparted thereto higher speed in view of the fact that it is moved faster due to the additional elongation of the fabric. This, however, means that the member just carrying out the de-needling operation applies—via the remaining members which respectively abut on one another—pressure to the first member just carrying out the needling-in operation, and this will be sufficient to cause jamming. Hence, jamming cannot be prevented simply by providing a sufficient amount of play.

The basic concept of the invention now resides in the fact that, in addition to the fundamentally necessary overall amount of play, measures are taken which guarantee that a subsequently following member always abuts on the member just carrying out the needling-in operation or that such a new member is moved up to the width of woven fabric in such a way that it has, at most, a distance, which lies within a predetermined maximum distance, from the member which is just carrying out the needling-in operation or which has just carried out said operation. This maximum distance depends on the elongation of the fabric and on the number of distances between the maximum number of members which are in needled-in engagement with the width of woven fabric, and it can be brought into relationship with the necessary amount of overall play. If the maximum distance is to be a length "a", the overall amount of play "G" must be larger than or equal to the elongation "b" of the fabric between the first point of needling in and the last point of de-needling plus the length $(n+1)\times a$, i.e.

$$G \geqq b+(n+1)\times a,$$

wherein "n" is the number of distances between the maximum number of members which are needled-in engagement with the width of woven fabric.

Figure 7:
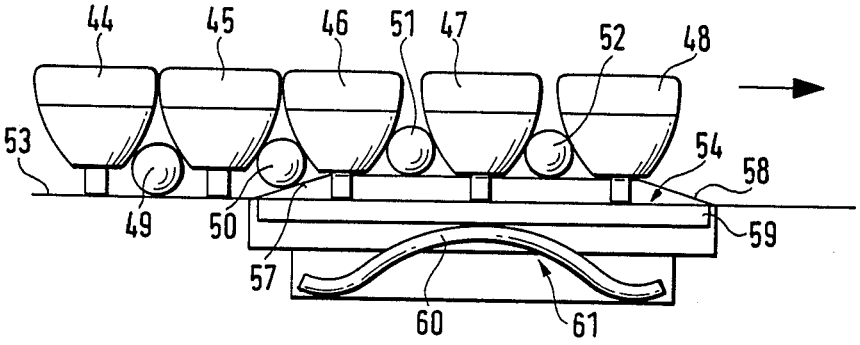
FIG. 7 shows a schematic representation of part of the endless guide path with an additional embodiment according to the invention.

In the following, it will be explained on the basis of some embodiments how a new member following the member just carrying out the needling-in operation can be moved up in good time. FIG. 7 show a series of members 44 to 48 whose structural design can correspond to that of the members shown resillient buffer members such as in FIG. 3 to 5. In this example, the endless guide path is not explicitly shown. Balls or rollers 49 to 52 run between respective pairs of said members. These balls are entrained by the respective following member and roll on a running surface 53. As can be seen on the basis of members 44 and 45, the lateral, downwardly extending bevels (cf. FIG. 4, the faces 32, 33, 34 and 35) are chosen such that there is room for the ball in the space thus created, even if the neighbouring members 44 and 45 abut on each other on their end faces (cf. FIG. 4, faces 30 and 31). In the path of motion of the ball a ramp 54 is provided, which consists of two parallel webs 55 and 56 extending essentially in the horizontal direction, said webs having, however, an ascending flank 57 and a descending flank 58 at the front and at the rear side in the direction of movement (cf. FIG. 7). The webs 55 and 56 are formed integrally with a base plate 59. Below said base plate, a leaf spring 60 is provided by means of which the whole ramp is pressed upwards. When the members are being advanced, the balls will only roll onto the ramp and, in so doing, they will press against the lateral, bevelled faces of the members, whereby said members are positioned in spaced relationship with one another, as can be seen from members 46 to 48. This has the effect that all the members positioned in front of the member 48, when seen in the direction of movement, are caused to carry out an additional forward movement. This forward movement should cover precisely such a distance that the first member following the member which is just carrying out the needling-in operation abuts on said member carrying out the needling-in operation.

If, in the case of this arrangement, it should happen that—due to the member just carrying out the de-needling operation—additional pressure is applied in forward direction to the preceding members, while the first member following the member which just carries out the needling-in operation already abuts on said last-mentioned member, it will be possible to take up this pressure by further pressing together the members 46, 47 and 48, in which case the ramp 54 will be pressed via the balls 51 and 52 into a recess 61 provided for said ramp 54 and for the leaf spring 60. The dimensions of the ramp should be long enough for holding a sufficient number of members in spaced relationship with one another so that the member just carrying out the de-needling operation should not under any circumstances lower the ramp to such an extent that all the members positioned above said ramp abut on one another.

Figure 6:
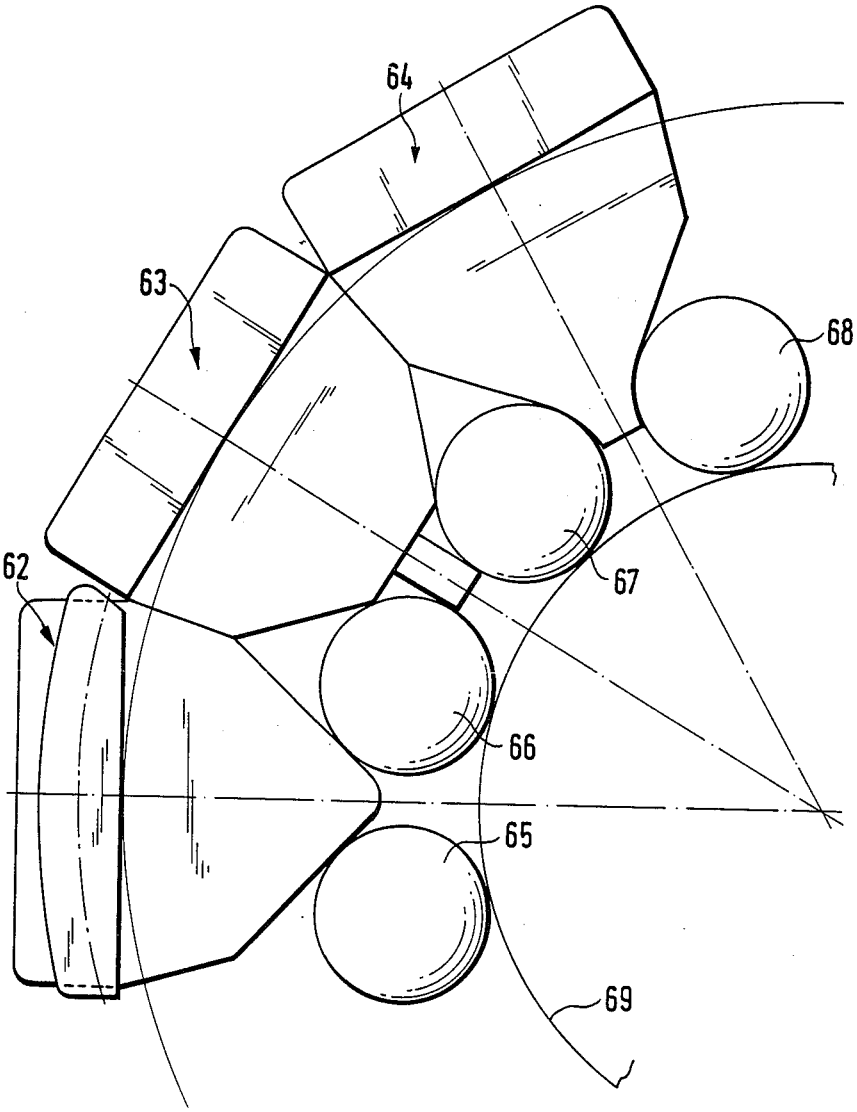
FIG. 6 shows a representation of several members each provided with a different possible shape, said figure showing the way in which said members abut on one another when running along an arcuate path.

FIG. 6 shows three different structural embodiments of members 62 to 64 for the purpose of illustrating how the lateral faces 32 to 35 of the members, which have already been described on the bases of FIG. 4, have to be designed for guaranteeing, on the one hand, an exactly abutting contact of the members also when said members are being guided round a curve and for providing, on the other hand, sufficient space for the resillient buffer means in the form of balls 65 to 68 guided between the members. The running surface 69, which is shown in this figure and one which the balls run, corresponds to the running surface 53 shown in FIG. 7.

Figure 8:
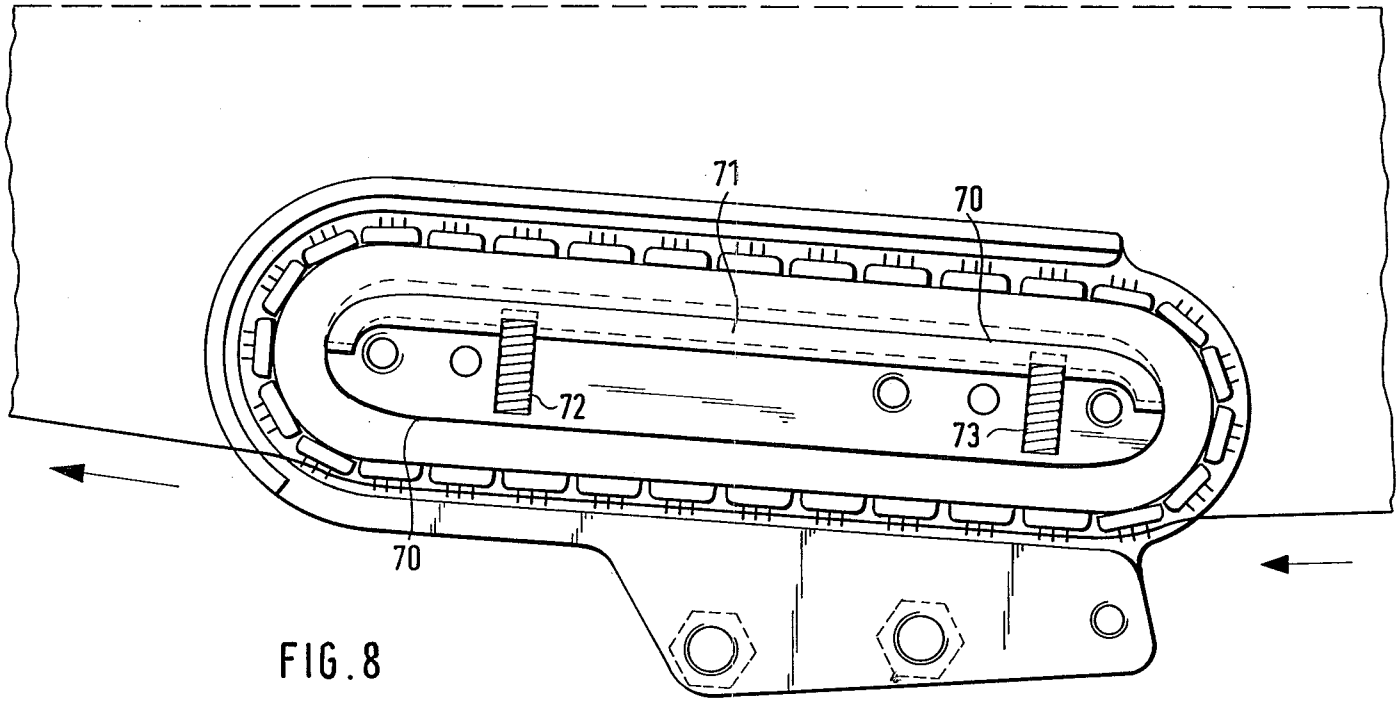
FIG. 8 shows a schematic top view of an additional embodiment having the structural design according to the invention.

FIG. 8 shows an overall arrangement of a temple corresponding essentially to the arrangement of FIGS. 6 and 7, the individual balls and the exact structural design of the members being, however, not shown. In the case of this arrangement, the running surface for the balls is defined by the oblong oval surface 70. The essential difference existing between this arrangement and the arrangement according to FIG. 7 and 8 only is that the ramp is defined by an elongate, essentially C-shaped part 71, which is adapted to be displaced outwards relative to the original running surface 70 of the balls with the aid of two springs 72, 73. This displaced position is shown by broken lines in the drawing.

Figure 9:
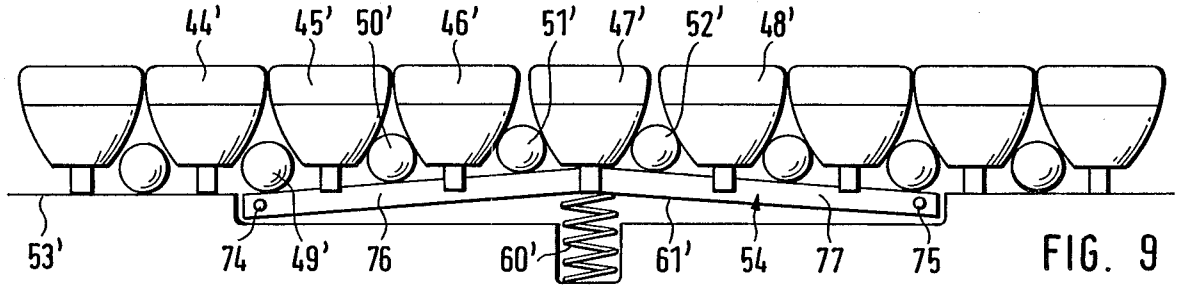
FIG. 9 shows a schematic fragmentary view of the endless guide path with an additional embodiment according to the invention.

An additional embodiment of a ramp is shown in FIG. 9. In view of the fact that this arrangement corresponds to the arrangement of FIG. 7, identical parts are provided with identical reference numerals plus an additional prime. The ramp 54' is defined by two levers 76 and 77, which are articulated at their oppositely disposed ends 74 and 75 and which are pretensioned upwards at their abutting ends with the aid of a helical spring 60'. These levers 76 and 77 only project into the path of motion of the balls 49' and 52'. When pressure is applied to the ramp, the legs can be pivoted to their lowered position within the recess 61'.

Figure 10:
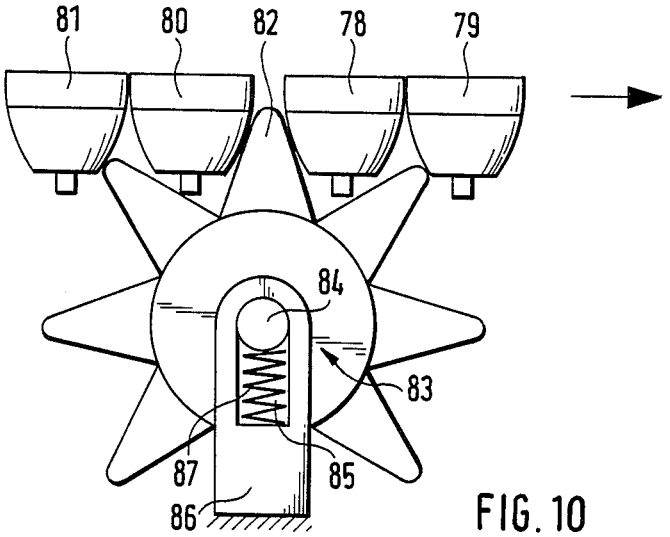
FIG. 10 shows a schematic fragmentary view of several members in the endless guide means with an additional embodiment according to the invention.

In accordance with the arrangement shown in FIG. 10, the members 78 and 79 are advanced in the direction indicated by the arrow due to the fact that the star or sprocket 82 of a star or sprocket wheel 83 engages between the members 78 and 80. The axle 84 of the star or sprocket is adapted to be displaced vertically within an elongate hole 85 of a bearing means. The axle 84 is pretensioned upwards by means of a helical spring 87. It follows that, in the case of excessive pressure of the members 80 and 81 in forward direction, the star or sprocket wheel 83 will inevitably be moved downwards against the force of the spring 87 so that the distance between the members 78 and 80 can be reduced.

Figure 11:
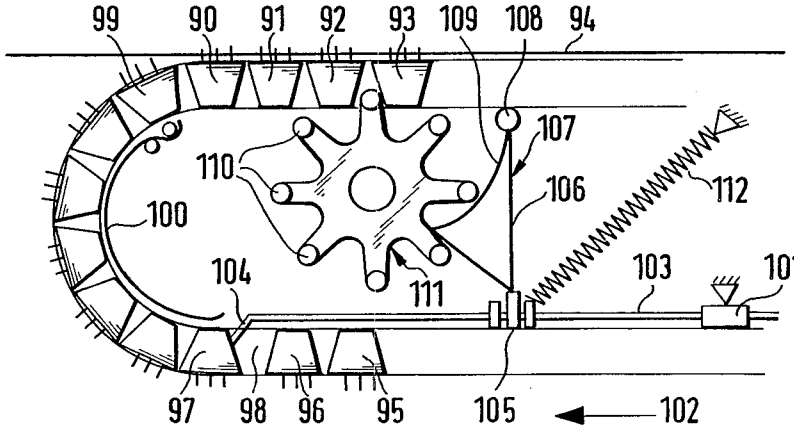
FIG. 11 shows a schematic representation of an additional embodiment according to the invention.

FIG. 11 shows a schematic representation of an arrangement in the case of which the members 90 to 93 are in needled-in engagement with the width of woven fabric 94. The members 95, 96 are the last members shown, which are advanced in abutting contact with each other due to the member just carrying out the de-needling operation. Between the member 96 and the following member 97 a sufficient amount of play 98 is provided. Between the member 97 and the member 99, which abuts on the member 90 which has just finished the needling-in operation, there are positioned additional members which abut on one another and which are held in this position by a pressure spring 100 extending along this path. In the slide guide means 101, a slide member is adapted to be displaced, said slide members being movable forwards and backwards in the direction of the arrow 102 and having at the front end thereof a driver 104. The slide member is, at 105, articulated on an arm 106 of a two-armed lever 107, which, in turn, is adapted to be pivoted about the articulation point 108. The other arm 109 of the two-armed lever is brought into engagement with the ends of the stars or sprockets 110 of a star or sprocket wheel 111. The star wheel is supported such that it is rotatable about a fixed axle and a star respectively engages between the members 92 and 93, whereby the star wheel is rotated in response to a movement of the width of fabric. The slide member itself is pretensioned in the direction of movement 102 by means of a pressure spring 112.

The mode of operation of this embodiment is the following one: when the width of woven fabric is advanced by the length of the distance between two members 92, 93, the star wheel will be advanced by the angle between two stars. In the course of this process, one of the stars is first brought into engagement with the second arm 109 of the two-armed lever 107 and pivots said arm counter-clockwise about the articulation point 108. This has the effect that the slide member 103 is moved backwards in a direction opposite the direction of advance 102 and against the force of the spring 112, the driver 104 being slightly raised due to the fact that the slide member 103 is slightly pivoted. As soon as, in the course of its continued movement, the star comes out of engagement with the arm 109, the slide member can move forward due to the spring 112 after having engaged behind the next following member 96 during its backward movement, said engagement being effected via the driver 104. When carrying out the forward movement, the slide member will thus push the member 96 into abutting contact with the member 97 and press all the preceding members against the last member 90 which has just finished the needling-in operation. Due to the pressure exerted by the spring 112, the slide member will continue to apply pressure to the preceding members until the next following member 99 has finished the needling-in operation. In the case of a further movement of the width of woven fabric by the length of the distance between two members, the sequence of motions is repeated cyclically.

Figure 12:
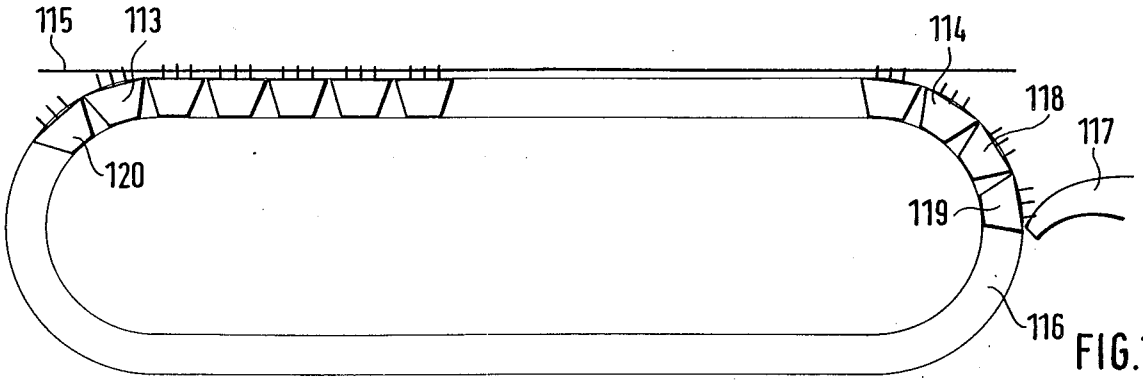
FIG. 12 shows a schematic representation of an additional embodiment according to the invention.

FIG. 12 shows an additional embodiment from which it will be evident that the overall amount of play in the endless guide means can practically be increased as much as desired. In the case of this embodiment, the members positioned between the member 113 just carrying out the needling-in operation and the member 114 just carrying out the de-needling operation are in engagement with the width of woven fabric 115. A compressed-air line 117 terminates in the endless guide means 116 tangentially in the direction of movement of the members, a jet of air being continuously blown into said guide means 116 through said compressed-air line. When the width of woven fabric 115 is advanced, the member 114 just carrying out the de-needling operation will advance the preceding members 118 and 119 until the member 119 has been moved past the opening of the compressed-air nozzle 117. At this moment, the member 119 will be caught by the jet of compressed air and moved along the guide means 116 until it abuts on the first member 113 just carrying out the needling-n operation. In this position it would take up the position of the member 120 shown. This arrangement shows that, for permitting smooth operation, it will, in principle, be sufficient when there are provided one or, at most, two members more than the number of members which are respectively in needled-in engagement with the width of woven fabric.

Figure 13:
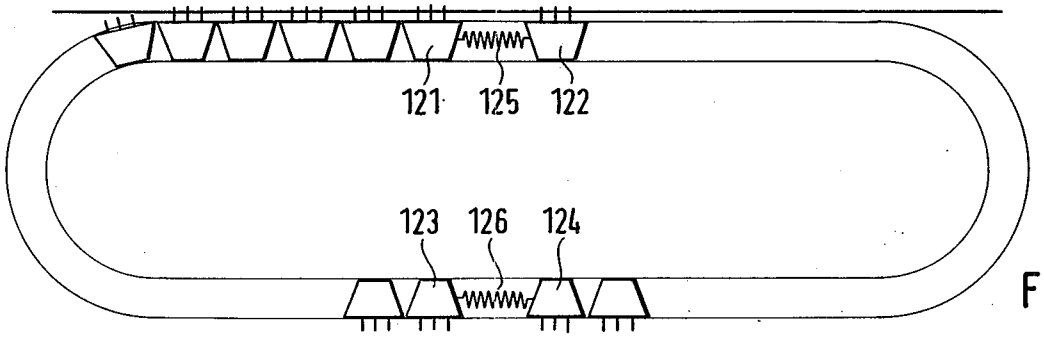
FIG. 13 shows a schematic representation of an additional embodiment according to the invention.

FIG. 13 schematically shows an embodiment in the case of which a pressure spring 125 and 126, respectively, is provided between two pairs of juxtaposed members 121/122 and 123/124, respectively, said pressure spring interconnecting the neighbouring members. The remaining length of the guide means can be equipped with abutting members, provided that the pairs of members having provided between them the respective spring are arranged on diametrically opposed locations on the guide means and provided that the respective distance between the neighbouring members, which is established by only one spring, it greater than the necessary overall amount of play within the guide means. It will, of course, be expedient to provide not only two springs, but, if possible, springs between each pair of neighbouring members. In this case, it will be expedient when the springs are constructed in the form of resilient buffer means, which hold respective neighbouring members at a predetermined distance from each other as long as no pressure is applied to said members. The distance established between two neighbouring members by the resilient buffer means—as long as no pressure applied to said members—can be very small in this case. Said distance can be chosen such that the sum of the distances between all members which are not in needled-in engagement with the width of woven fabric is greater than the maximum elongation of the width of woven fabric between the point of needling-in and the point of de-needling. Preferably, resilient buffer means consisting of a rubber or synthetic material are used. The material preferably used in this connection is polyurethane.

In accordance with a further embodiment of the invention, which is not shown in detail in the drawings, a guide means was used in the case of which the guide path itself consisted of several subcomponents. At least two neighbouring subcomponents had inserted between them a tension spring element in such a way that the length of the guide path increased automatically in cases in which an increasing amount of pressure was applied to the members in the guide path. A similar embodiment showed the features that the guide path itself was formed of a resilient plastic material capable of expanding in response to a pressure applied to the members in the direction of movement of said members. In the case of these arrangements, it was not necessary to provide a specific amount of overall play between the individual resilient buffer means such as members from the very beginning. On the contrary, the guide path was normally constructed such that, in response to pressure applied to the members, it permitted an increase in length of said path, which was at least equal to the overall amount of play demanded. It follows that, in such an arrangement, in the case of which the path, prior to being used, is in its condition of minimum length due to its resilient elements or due to its inherent elasticity, the individual members can be arranged in the guide path practically without any amount of overall play. The necessary amount of "play" is in this case only obtained during operation due to the increase in length of the guide path.

In accordance with one embodiment, the length of a member was 10 mm. On the endless guide means, which has an oblong oval shape, the rectilinear portion had a length of approx. 12 to 14 members. The width of woven fabric was guided such that, in addition to the members located on the straight portion, further one and a half or also two members were in needled-in engagement with the width of woven fabric along the curved path. Depending on the type of woven fabric, the overall elongation of the width of woven fabric between the point of needling-in and the point of de-needling ranged from 3 to 5 mm.

Figure 14:
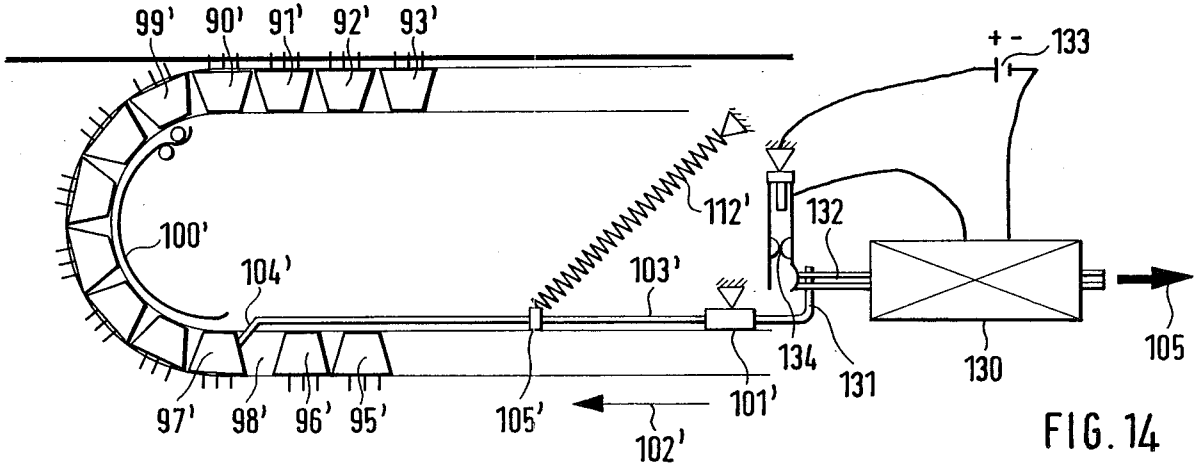
FIG. 14 shows a schematic representation of an additional embodiment according to the invention.

FIG. 14 shows an embodiment similar to that of FIG. 11, and, consequently, identical parts have been provided with identical reference numerals which had only added thereto a prime. Hence, these parts will not be discussed again in detail. In the case of the embodiment shown in FIG. 12, the slide member 103 is driven in response to the movement of the star wheel 111 and in response to the pivotal displacement of the two-armed lever 107. In the case of the embodiment according to FIG. 14, the drive of the slide member 103' is replaced by an electromagnet 130 which is coupled at the rear end 131 of the slide member via its armature 132. The electromagnet is adapted to have supplied thereto current from a source of current 133 via an on-off switch 134.

The mode of operation of this device is the following one: due to the force of the pressure spring 112', the driver 104' of the slide member 103' abuts on the rear end of the member 97'. The slide member is advanced in the direction of movement of the arrow 102' to the extent to which said member moves forward. Hence, the rear end 131 of the slide member and the armature 132 of the electromagnet 130 move as well. In a predetermined position, the normally open on-off switch 134 is closed, whereby the electromagnet 130 is excited. This has the effect that the armature is moved in the direction of the arrow 105 together with the slide member 103'. This means that the driver 104' is drawn back and slides over at least the next free member 96'. Due to the fact that the electromagnet 130 is fed via the switch 134, which is opened when the electromagnet is being actuated, said electromagnet only has supplied thereto a pulse whereupon it is deactuated again. The driver, which now engages behind the member 96', is advanced by the spring 112' in the direction of the arrow 102' until this new member abuts on the preceding member 97'. The driver will then again move in the direction of the arrow 104' to the extent to which the members are advanced during the needling-in operation until the switch 134 is closed again and a new cycle takes place.

Figure 15:
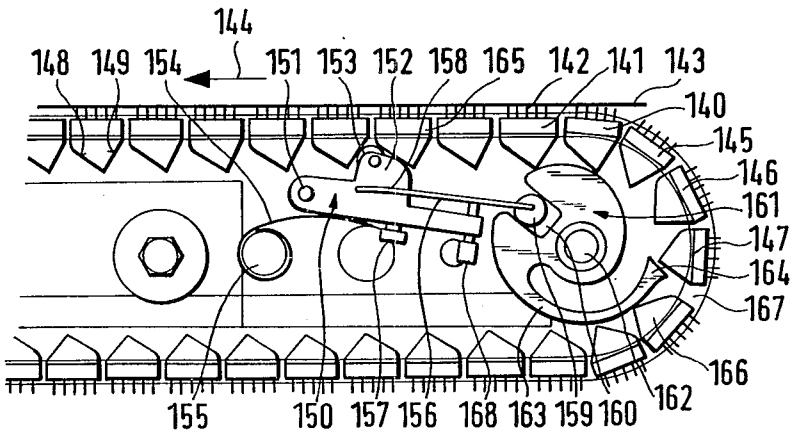
FIG. 15 shows a schematic representation of still another embodiment according to the invention.

In the case of the embodiment according to FIG. 15, the members 140, 141, 142 etc. are already in needled-in engagement with the width of fabric 143. The width of fabric 143 moved in the direction of the arrow 144. The last member 140 which is in needled-in engagement with the width of fabric is preceded by the members 145, 146 and 147, which abut on one another and which, in particular, abut on the last member 140 which is in needled-in engagement with the width of fabric. Each member has—on its side facing away from the width of fabric 143—a first flank 148, which slowly ascends in the direction of movement of said width of fabric, and a slightly more steeply descending second flank 149.

A pivotable lever 150 is supported such that it is adapted to be pivoted about a pivot axle 151. The pivotable lever 150 is provided with a cam follower member 152 with a roll 153, which is rotatably supported therein and which, when a member is being advanced, runs along the flanks 148 and 149 of each member. By means of a torsion spring 154, which is wound around a pin 155, the pivotable lever 150 is pretensioned anticlockwise about its pivot axle 151. A leaf spring 156 is supported in said pivotable lever 150 in such a way that it is held, with the aid of a screw 157, within a slot 158 in the pivotable lever 150 such that it is adjustable in the longitudinal direction of the leaf spring and, at the same time, approximately in the longitudinal direction of the pivotable lever.

At the end of the leaf spring 156, a thickened portion is formed, which has, for example, the shape of a ball or of a transversely extending cylinder and which engages a radial elongate recess 160 of a rotary member 161. The rotary member 161 is adapted to be rotated about a stationary axis of rotation 162. The rotary member has formed thereon an arm 163, which, in the case of the present embodiment extends—practically in the form of a leaf spring—at a constant radial distance round the point of rotation 162. The end of the arm 163 has formed thereon a driver projection 164. The driver projection 164 abuts on the rear second flank of the member 147.

The mode of operation of this device is the following one: when the width of fabric 143 is being advanced in the direction of movement 144, the roll 153 of the cam follower 152 runs up the first flank 148 of the member 165. This has the effect that the pivotable lever 150 is pivoted clockwise about its pivot axle 151 until the roll has reached the point of intersection between said first and second flanks 148, 149. In the course of this rotary movement of the pivotable lever 150, the thickened end 163 of the leaf spring 156 can slide in the radial recess 160 and, during the movement of said pivotable lever, it will rotate the rotary member 161 anticlockwise. In view of the fact that the driver projection 164 on the arm 163 springily presses against the back of the member 147, the members 147, 146 and 145 will be pressed onto the member 140, which is just carrying out the needling-in operation, under pretension. The dimensions and transmission ratios, which will still be discussed hereinbelow, are chosen such that the free member following the member which has just finished the needling-in operation is just about to start the needling-in operation when the roll 153 of the cam follower has reached the point of intersection between the flanks 148 and 149. When the width of fabric is moved on, the roll 153 will then follow the second flank 149 of a member, the pivotable lever 150 being again pivoted anticlockwise, whereas the rotary member 161 is simultaneously rotated clockwise. Due to the different degrees of flank steepness of the flanks 148, 149, these movements take place at a higher speed than the above-described movements. In the course of this clockwise movement of the rotary member 161, the driver projection 164 comes out of engagement with the member 147 and is moved back to such an extent that it engages behind the second descending flank of the member 166, which was, of course, advanced during the advance movement of the last member 147 by the members following after the member 166. The backward movement of the driver projection 164 will in any case be sufficient for moving said driver projection backwards not only by the length of one member but also by the length of the gap 167 provided due to the free play between the free members.

The clockwise backward movement of the driver projection 164 will be finished when the roll 153 is positioned between the descending flank of the preceding member and the ascending flank of the next following member and when said roll begins to follow the ascending flank of said next following member. In the course of this following movement, the member 166 is more rapidly moved towards the preceding member 147 by the driver projection 164 and, in the course of the continued movement of the roll 153 on the first ascending flank of the member 142, the preceding members 146 and 147 are held in pretensioned abutting contact with the member 145 which has been brought into needled-in engagement with the width of fabric in the meantime. This pretension is produced primarily by the springy arm 163.

In order to adjust the rotary angle through which the rotary member 161 rotates when the pivotable lever 150 is being pivoted, the transmission ratio between the pivotable lever 150 and the rotary member 161 can be adjusted by changing the position of the leaf spring 156 in its gap 158 in the longitudinal direction of said leaf spring. This is effected by loosening and tightening the screw 157. The pivotable lever 150 is thus increased or reduced in length in an appropriate manner. At the same time, the radial distance from the axis of rotation 162, at which the end or rather the thickened portion 159 of the leaf spring 156 acts on the rotary member 161, is reduced or enlarged. On the basis of a correct adjustment which is adapted to the size of the members and to the respective amount of play 167 provided, it is possible to achieve that the leaf spring 156 need not take up any additional forces during the pivotal movement of the pivotable lever 150 as well as during the rotary movement of the rotary member 161. In this case, the leaf spring can practically be regarded as being rigid. On the basis of such an adjustment, the device will run extremely smoothly. If, notwithstanding this, the existing amount of play 167 should vary slightly during operation, the resultant length differences can be taken up easily by an adequate degree of bending of the leaf spring 156. Hence, automatic adaptation to such variation is effected.

An adjustment or fine adjustment of the driver projection 164 can additionally be effected by means of a second adjustment screw 168 with the aid of which the leaf spring is bent relative to its rectilinear shape. This causes a change in the point of engagement between the thickened portion and the radial elongate recess 160 and, consequently, a change in the radial distance at which the end of the leaf spring 156 acts on the rotary member 161. The rotary member 161 can, for example, be made of a plastic component.

In accordance with another embodiment, which is not shown, there may be provided a motor for the purpose of holding the respective member, which follows the member just carrying out the needling-in operation, in abutting contact with said last-mentioned member, said motor being provided with a reduction gearing driving a rotary brush. The rotary brush may have bristles of some length consisting e.g. of a plastic material. The bristles should be of such a nature that, when the rotary brush rotates, they come into contact with the inner side of at least two successive members or that they pass lightly over said inner side. The abutting contact of the respective members can be achieved by making the rotary brush rotate at a slightly higher circumferential speed than the speed of motion of the individual abutting members. This has the effect that the brush will brush over the individual members and hold these members in mutual abutting contact. In view of the fact that the width of fabric itself moves at a very low speed, also the rotary brush can rotate at a very low, but still higher speed.

I claim:

1. A temple for securing a woven fabric advanceable in a weaving apparatus, the temple comprising endless guide means having displaceably arranged therein a plurality of discrete, unconnected members provided with needles for engagement with said woven fabric, said guide means providing a displacement path along which said members are constrained to travel between a fabric needling-in position and a fabric de-needling position, said displacement path being angularly inclined with respect to a longitudinal axis of the woven fabric and convergent in the direction of advancement of the fabric, the displacement path being arranged such that the needles of at least two members are simultaneously in engagement with an edge of the woven fabric and that, in the course of fabric needling-in, the needles brought into engagement with the woven fabric are located at a greater distance from the longitudinal axis of the width of woven fabric than they are in the course of fabric de-needling characterized in that the members are supported in such a way that they can be displaced relative to one another such that the aggregate amount of space between all members on the endless guide means is at least as great as the amount of fabric elongation between the needling-in position and the de-needling position, there being means provided for holding within a predetermined distance one of said plurality of members adjacent the member in the needling-in position.

2. A temple according to claim 1, characterized in that each of the members is independently displaceable in the guide means.

3. A temple according to one of claims 1 or 2, characterized in that the temple comprises generally opposed first and second guide rails, one of the guide rails having a lateral member support surface, each of the members having first and second legs joined so as to provide the member with an L-shaped cross-section, in which the first leg is provided with a first side to which is secured at least one fabric-engageable needle and a second side engageable with the guide rail lateral support surface, and in which the second leg is positioned between the first and second guide rails.

4. A temple according to claim 3, characterized in that the first leg further includes a projection and a corresponding one of the rails is provided with a groove configured to receive the leg projection.

5. A temple according to claim 1, characterized in that at least one of the members is provided with lateral, generally opposed sides which are bevelled inwardly along at least a portion of their length towards the guide means, further comprising a buffer member positioned between respective pairs of neighbouring abutting members, said buffer member being, in response to a movement of the members, entrained and guided in the endless guide means and a resilient cam path provided in an area of the endless guide means in which the membes are out of engagement with the width of woven fabric, said cam path resiliently projecting into the path of movement of the buffer members and which, while said buffer members pass over said cam path, holds said buffer members in position in which they are displaced relative to the neighboring members and in which said buffer members hold the respective neighboring members at a predetermined distance from one another.

6. A temple according to claim 5, characterized in that the buffer members consist of balls, cylinders or wedges.

7. A temple according to claim 5 or 6, characterized in that the cam path is formed by a ramp which is pretensioned by a spring and which, in response to a pressure acting in the direction of mutual abutting contact of the members and applied to the members which are out of engagement with the width of woven fabric, is displaceable by the buffer members and against the force exerted by the spring to a position outside of the original path of movement of the buffer members.

8. A temple according to claim 7, characterized in that the ramp is formed by an C-shaped edge of a plate which is adapted to be springily displaced relative to the endless guide means in the plane of the endless guide means, said C-shaped edge extending essentially along one longitudinal half and parallel to the endless guide means.

9. A temple according to claim 7, characterized in that the ramp is formed by two adjoining levers which are articulated at their oppositely disposed ends and which are pretensioned at their abutting ends by a spring, said levers projecting into the path of movement of the buffer members.

10. A temple according to claim 1, 2 or 4, characterized in that there is provided a motor with a rotary brush having a plurality of bristles, the brush bristles being engageable with at least one of said plurality of members positioned in front of the member undergoing needling-in of the fabric, the rotary brush being rotatable at a circumferential speed in which is higher than the speed of the members in needled-in engagement with the width of woven fabric.

11. A temple according to claim 1, 2 or 4, characterized in that there is provided a pivotable lever having a cam follower member mounted thereon, said pivotable lever being resiliently pretensioned relative to members adjacent the needling-in position, said members being provided with cam surfaces engageable with said cam follower, and that the pivotable lever is engageable with a rotary member having a ratchet pawl for engaging with and for advancing members towards the member just carrying out fabric needling-in.

12. A temple according to claim 11, characterized in that the rotary member is provided with a radial recess which is brought into engagement with the end of the pivotable lever.

13. A temple according to claim 12, characterized in that an end of the pivotable lever is formed by a leaf spring mounted in said pivotable lever.

14. A temple according to claim 13, characterized in that an end of the leaf spring is longitudinally adjustable in position on the lever for providing an adjustable transmission ratio between the pivotable lever and the rotary member.

15. A temple according to one of the claims 12 to 14, characterized in that the radial recess has the shape of a forked recess.

16. A temple according to claim 11, characterized in that the rachet pawl has the shape of a driver projection.

17. A temple according to claim 16, characterized in that the driver projection is formed at an end of a rotary member arm.

18. A temple according to claim 11, characterized in that the rotary member is comprised of a plastic material.

19. A temple according to claim 1, characterized in that there is provided an axle-mounted sprocket wheel having a plurality of sprockets radially mounted thereon, said axle being displaceably supported in the direction of the endless guide means and resiliently pretensioned relative to said endless guide means, at least one of said sprockets being engageable between two neighbouring members which are out of engagement with the width of woven fabric for keeping said members at a predetermined distance from each other as long as said members do not have applied thereto any pressure in the direction of mutual abutting contact of said members.

20. A temple according to claim 1, characterized in that there is provided a slide member which is adapted to be moved forwards and backwards along members not engaged with the width of woven fabric in step with the needling-in movement of a member and which engages behind a nonfabric engaged member with each backward motion, said slide member, when moving forward, applying a pressure to all the members positioned in front of the slide member in the direction of movement so as to hold in abutting contact the member positioned adjacent the member carrying out fabric needling-in.

21. A temple according to claim 20, characterized in that there is provided a rotatably supported sprocket wheel having a plurality of sprockets mounted thereon for successively engaging between two members which are in engagement with the woven fabric, there being further provided a pivotably supported two-armed lever having a first arm articulated on the slide member, which first arm is springily pretensioned in its direction of movement, and having a second arm arranged such that it projects into the path of movement of the ends of the sprockets of the sprocket wheel.

22. A temple according to claim 20, characterized in that the slide member is pretensioned in its direction of advance by means of a spring, and that an electromagnet is provided, which is coupled to said slide member and which is used for intermittently drawing back said slide member in response to actuation of said electromagnet.

23. A temple according to one of the claims 20 to 22, characterized in that, along the path of the members which are positioned in front of the slide member and which are out of engagement with the width of woven fabric, there is provided a brake spring for preventing the members from sliding back while the slide member is carrying out its backward movement.

24. A temple according to claim 1, characterized in that there is provided means for introducing a jet of compressed air in the direction of the forward movement of the members which are out of engagement with the woven fabric, said jet of compressed air being used for returning the respective members which have finished fabric de-needling into abutting contact with the member just carrying out fabric needling-in.

* * * * *